US006836254B2

(12) United States Patent
Kalis et al.

(10) Patent No.: US 6,836,254 B2
(45) Date of Patent: Dec. 28, 2004

(54) ANTENNA SYSTEM

(76) Inventors: Antonis Kalis, University of Patras, Dept. of Electrical Technology Lab of Electromagnetics, 26500 Rion Campus, Patras (GR); Theodore Antonakopoulos, University of Patras, Dept. of Electrical Technology Lab of Electromagnetics, 26500 Rion Campus, Patras (GR); Vassilios Makios, University of Patras, Dept. of Electrical Technology Lab of Electromagnetics, 26500 Rion Campus, Patras (GR); Donald W. Moses, 1590 Murphy Pkwy., Eagan, MN (US) 55122; Charles H. Hustig, 2147 Rampart Range Rd., Woodland Park, CO (US) 80863

( * ) Notice: Subject to any disclaimer, the term of this patent is extended or adjusted under 35 U.S.C. 154(b) by 11 days.

(21) Appl. No.: 10/215,704

(22) Filed: Aug. 10, 2002

(65) Prior Publication Data

US 2003/0030588 A1 Feb. 13, 2003

Related U.S. Application Data

(60) Provisional application No. 60/311,330, filed on Aug. 10, 2001.

(51) Int. Cl.[7] ..... H01Q 13/10

(52) U.S. Cl. ..... 343/770; 343/700 MS; 343/795

(58) Field of Search ..... 343/770, 700 MS, 343/795, 846; H01Q 13/10

(56) References Cited

U.S. PATENT DOCUMENTS

| | | | | | |
|---|---|---|---|---|---|
| 4,356,492 | A | * | 10/1982 | Kaloi | 343/700 MS |
| 4,673,832 | A | * | 6/1987 | Murakami et al. | 343/795 |
| 5,572,226 | A | * | 11/1996 | Tuttle | 343/726 |
| 5,923,296 | A | * | 7/1999 | Sanzgiri et al. | 343/700 MS |
| 6,163,306 | A | * | 12/2000 | Nakamura et al. | 343/797 |
| 6,252,560 | B1 | * | 6/2001 | Tanaka et al. | 343/853 |
| 6,281,849 | B1 | * | 8/2001 | Brachat | 343/700 MS |
| 6,342,868 | B1 | * | 1/2002 | Tsai et al. | 343/795 |
| 6,535,172 | B2 | * | 3/2003 | Hirabayashi | 343/725 |

* cited by examiner

*Primary Examiner*—Hoanganh Le
(74) *Attorney, Agent, or Firm*—Haynes and Boone, LLP

(57) ABSTRACT

Provided is an antenna system for operating in clear line of sight and obscured line of sight conditions. The antenna system includes multiple antenna elements arranged to provide both space and angle diversity characteristics. The elements are spaced apart so as to provide independence but may have overlapping radiation patterns. Each element includes a main radiation lobe and the elements are arranged so that the main radiation lobes are oriented at diverse angles.

20 Claims, 5 Drawing Sheets

ANTENNA SYSTEM

CROSS-REFERENCE

This application claims priority from U.S. Provisional Patent Application Ser. No. 60/311,330, filed on Aug. 10, 2001.

BACKGROUND

This invention relates to an antenna system and, more particularly, to an antenna system for overcoming the deleterious effect of multipath.

The multipath effect is the result of radio waves reflecting off of surfaces before reaching their destination. The reflections, which occur commonly both indoors and outdoors, vary in strength depending on such factors as their proximity to the transmitter and the surface type of the material off which they are reflecting. The reflections may reach the destination at different times from the main signal and each other, resulting in signal fluctuations. Relatively weak reflections may be insignificant, but stronger reflections may result in undesirable signal quality.

One approach to overcoming the multipath effect focuses on antenna diversity. There are two main design streams for developing diversity arrays. These design streams address the two main cases of transmission in an indoor environment, which are (1) transmitting with a clear line of sight (LOS) between transmitter and receiver and (2) transmitting with an obscured line of sight (OBS).

In the first case, the received signal quality can be optimized when an antenna with a very narrow beam is aimed at the transmitter site. This method may be highly efficient for LOS cases since the LOS signal is generally the strongest of all multipath components, and the narrow beam attenuates all the multipath signals except those in the line of sight.

The disadvantages of the LOS method are related to implementation issues. In order to produce very narrow beams, large antenna arrays are needed. However, large arrays may be difficult to integrate in an indoor wireless product. Moreover, implementing a design that would have four very narrow beams and the ability of covering 180 degrees in the azimuth would dramatically increase the cost of the design. Therefore, an angle diversity scheme is implemented for an indoor wireless product and the use of wide beams cannot be avoided. Since the most severe multipath components have a small angular spacing from the main LOS signal, the limitations of implementing angle diversity in small arrays are quite clear.

In the second case, where the transmission occurs with an obscured line of sight, angle diversity with very narrow beams may be misused. In these cases, the use of wide beam widths and space diversity is more effective. The main idea behind space diversity is to use a number of omni-directional antennas placed a distance apart so that the received signals from each antenna show low correlation. It is expected that the hyperthesis of the different instances of the multipath signals at each antenna element will produce a high signal quality on at least one of the elements. The larger the number of elements, the larger the probability of receiving a signal of high quality.

However, space diversity presents some significant disadvantages. Since omni-directional antennas are used, the elements' gain is rather low, which means that the distance between transmitter and receiver cannot be extended. Additionally, space diversity cannot decrease the delay spread of the signals received. This means that although the bit rate of a channel using space diversity may be increased, the symbol rate is limited.

Therefore, it is desirable to merge the positive characteristics of the LOS and OBS diversity schemes. It is also desirable to be efficient in terms of cost and size constraints in the construction of an antenna structure.

DESCRIPTION

Figure 1:
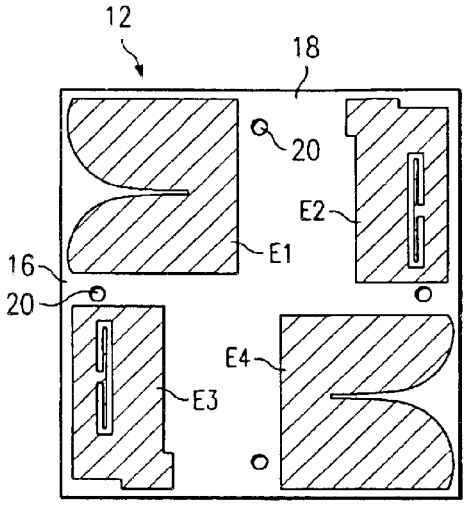
FIG. 1 is a schematic view of the surface of an antenna array board which faces outward in an antenna system.

In order to solve the above technical problems, a first aspect of the invention is an antenna system which merges desirable characteristics of the LOS and OBS diversity schemes, so that the system responds to multiple configurations, yet meets desired cost and size constraints for the system. It is understood, however, that the following disclosure provides many different embodiments, or examples, for implementing different features of the invention. Specific examples of components and arrangements are described below to simplify the present disclosure. These are, of course, merely examples and are not intended to limit the invention from that described in the claims. In addition, the present disclosure may repeat reference numerals and/or letters in the various examples. This repetition is for the purpose of simplicity and clarity and does not in itself dictate a relationship between the various embodiments and/or configurations discussed.

Referring generally to FIGS. 1–6, an exemplary antenna system 10 is designed utilizing an antenna array board 12 and a ground plane board 14 to fit in an indoor electrical product (not shown), such as a loudspeaker configuration, for the purpose of transmitting an audio signal to be reproduced to the loudspeaker. In this context, it is understood that a power amplifier is mounted in, or near the loudspeaker, and includes an input for receiving the audio signal via the antenna system of the present invention and an output for connection to the loudspeaker for driving same.

Referring now specifically to FIG. 1, the antenna system 10 comprises in part the antenna array board 12 which includes an exterior side 16. The exterior side 16 includes four antenna elements E1, E2, E3, and E4, which are separated by one or more spaces 18. The four elements E1–E4 are directional and each element includes a main radiation lobe, which is an identifiable segment of the particular element E1–E4's radiation pattern which exhibits the greatest field strength. The elements E1–E4 are configured such that their respective main radiation lobes are oriented toward diverse azimuth angles. This configuration produces desirable angle diversity characteristics. However, due to the fact that the main radiation lobes of the elements are overlapping for a number of azimuth angles, it is possible that in some cases the received signals would be highly correlated. Therefore, the spacing of the elements E1–E4 is ideally relatively large in order to minimize the correlation of the received signals in any environment, which provides beneficial space diversity characteristics.

The antenna array board 12 also includes four holes 20, which enable the antenna array board 12 to be aligned with and connected to a ground plane board as will be described later. For purposes of illustration, the dimensions of the antenna array board 12 are 3.00×3.25 inches.

Figure 2:
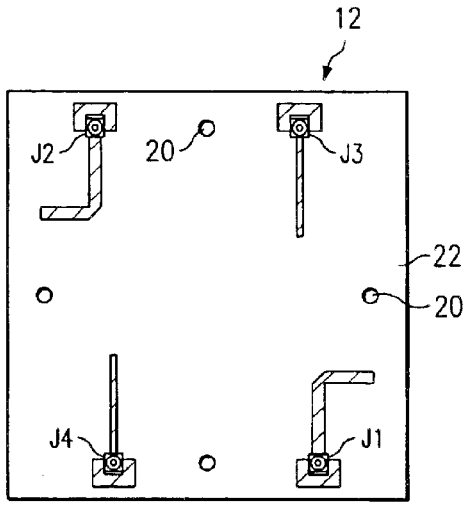
FIG. 2 is a schematic view of the surface of the antenna array board of FIG. 1 which faces inward in the antenna system.

Referring now to FIG. 2, an interior side 22 of the antenna array board 12 illustrates the reverse of side 16 of FIG. 1. The side 22 includes four connectors J1, J2, J3, J4, which may be commonly available surface mount coaxial connectors. The connectors J2 and J3 are placed on the top edge of the antenna array board 12 as illustrated in FIG. 2, and the connectors J1 and J4 are placed on the bottom edge of the antenna array board 12. The four connectors J1–J4 are operable to connect the antenna array board 12 to another device (not shown), such as a radio frequency (RF) device. For example, the RF device may be an RF power amplifier in a transmitter, while the RF device may be an RF board in a receiver.

Figure 3:
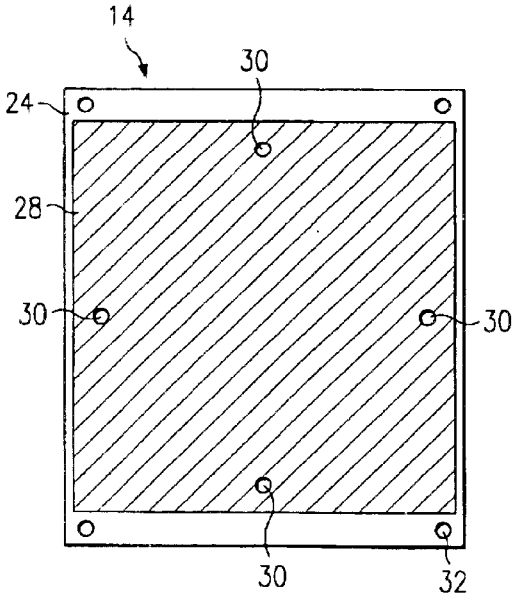
FIG. 3 is a schematic view of the surface of a ground plane board which faces inward in an antenna system.
Figure 4:
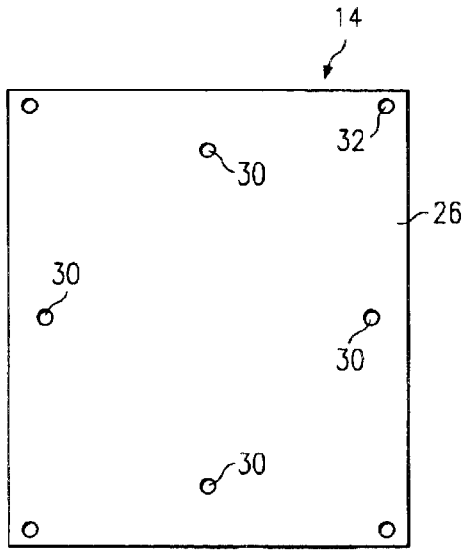
FIG. 4 is a schematic view of the surface of the ground plane board of FIG. 3 which faces outward in the antenna system.

Referring now to FIGS. 3 and 4, a ground plane board 14 comprises an interior side 24 and an exterior side 26. The interior side 24 includes a reflector 28, which serves to reflect signals as described in greater detail later. The exterior side 26 may be a blank surface as illustrated. As illustrated by both FIGS. 3 and 4, the ground plane board 14 includes four holes 30 positioned so as to align with the holes 20 of FIGS. 1 and 2. In addition, the ground plane board 14 may include a plurality of holes 32, the holes 32 enabling the ground plane board 14 to be mounted upon or fastened to a surface (not shown).

Figure 5C:
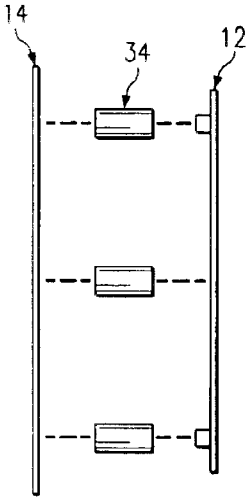
FIGS. 5*a–c* provide an orthographic view of an exemplary antenna system formed by the surfaces illustrated in FIGS. 1–4.
Figure 5A:
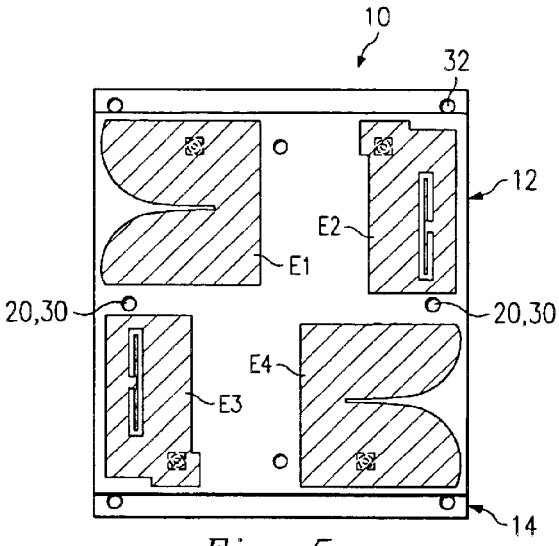
Figure 5B:
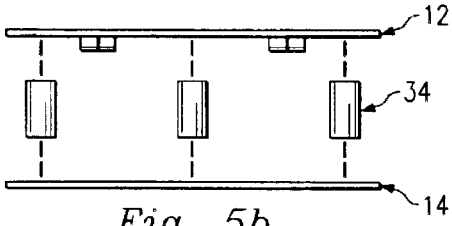

Referring now to FIGS. 5*a*–*c*, the antenna array board 12 of FIGS. 1 and 2, and the ground plane board 14 of FIGS. 3 and 4 may be connected as illustrated to form the antenna system 10. The antenna array board 12 and the ground plane board 14 are positioned so that they are separated by a desired distance using nylon spacers 34. For example, the two boards 12 and 14 may be separated by a distance of 12 millimeters (mm). The spacers 34 may be placed as illustrated, or an alternative number of spacers 34 may be utilized and/or positioned so as to achieve a desirable level of connectability. The spacers 34 are placed so that screws or other fastening means may connect the boards 12 and 14 at the location of the holes 20 and 30, respectively. Alternatively, the use of an adhesive type fastener would enable the spacers 34 to be positioned elsewhere on the boards. In the present embodiment, as illustrated in FIGS. 5*a* and 5*c*, one dimension of the ground plane board 14 exceeds that of the antenna array board 12 so that the holes 32 are accessible for use in attaching the antenna system 10 to a surface.

The orientation of the boards 12, 14, is such that the respective interior sides 22, 24, face each other and the respective exterior sides 16, 26, face away from each other. In this orientation, the reflector 28 serves to reflect signals towards the elements E1–E4.

Figure 6:
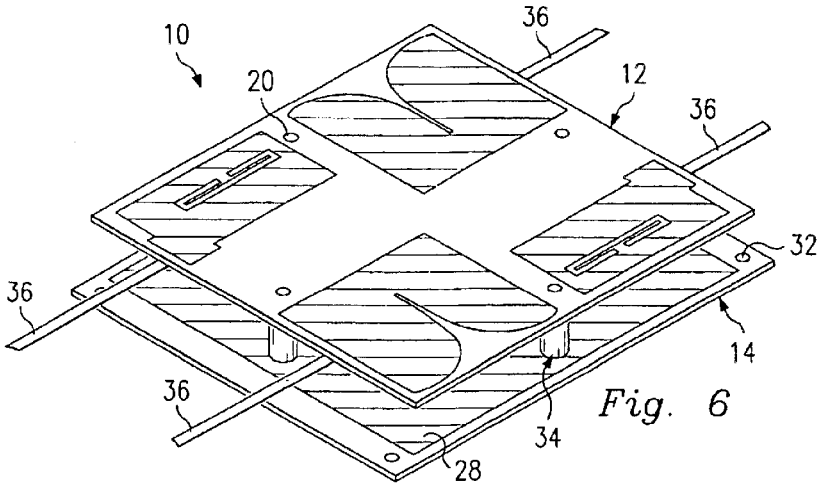
FIG. 6 is an isometric view of the antenna system of FIG. 5.

Referring now to FIG. 6, the orientation of the boards 12, 14, is further illustrated. Also shown are four RF coaxial cables 36 connectable to the connectors J1–J4 of FIG. 2.

The above described embodiment integrates both angle and space diversity in the antenna system 10. Each antenna array element E1–E4 is independent, with a low interelement coupling. For example, each element has a high gain, a 3 dB beamwidth of approximately 60 degrees, and may be aimed at diverse azimuth angles. Therefore, the system implements angle diversity and is efficient in LOS cases, reducing the delay spread of the received signals and increasing the power efficiency of the transmission. Additionally, since the hyperthesis of all the radiation patterns produces a lobe with more than 150 degrees beamwidth, for example, the array structure should be efficient in OBS cases.

In addition, the elements have overlapping radiation patterns. This means that signals arriving from most azimuth angles will be received from more than one element at the same time. Therefore, the strongest multipath components, which in the LOS cases have a small angular distance from the LOS signal, will be received from more than one element. Consequently, the possibility of at least one element producing a signal with high quality is increased. In other words, space diversity is also implemented in the above design.

Referring now generally to FIGS. 7–12, in another embodiment, an antenna system 40 is designed to fit in a relative large indoor electronic device (not shown), such as a loudspeaker. As in the previous embodiment, the antenna system 40 includes an antenna array board 42, which includes an exterior side 44 and an interior side 46, and a ground plane board 48, which includes an interior side 50 and an exterior side 52.

Figure 7:
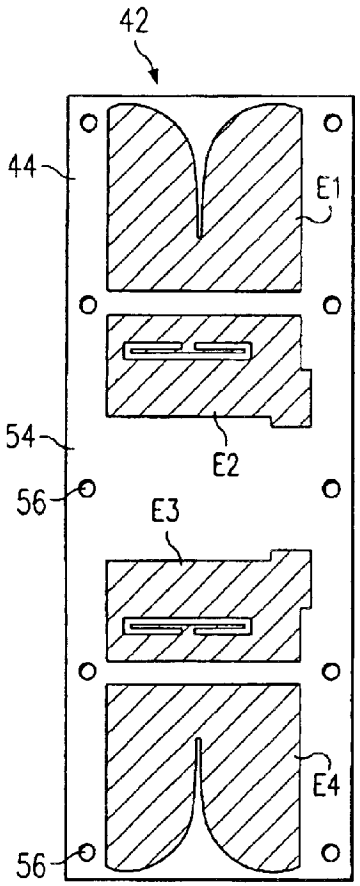
FIG. 7 is a schematic view of the outward-facing surface of another embodiment of an antenna array board.

Referring now specifically to FIG. 7, the exterior side 44 includes four antenna elements E1, E2, E3, and E4, which are separated by one or more spaces 54. The four elements E1–E4 are directional and each element includes a main radiation lobe. The elements E1–E4 are configured such that their respective main radiation lobes are oriented toward diverse azimuth angles.

As described previously, this configuration produces desirable angle diversity characteristics but, due to the fact that the main radiation lobes of the elements are overlapping for a number of azimuth angles, some of the received signals may be highly correlated. Therefore, the spacing of the elements E1–E4 is relatively large in order to minimize the correlation of the received signals in any environment, which provides beneficial space diversity characteristics.

The antenna array board 42 also includes ten holes 56, which enable the antenna array board 42 to be aligned with and connected to a ground plane board as will be described later.

Figure 8:
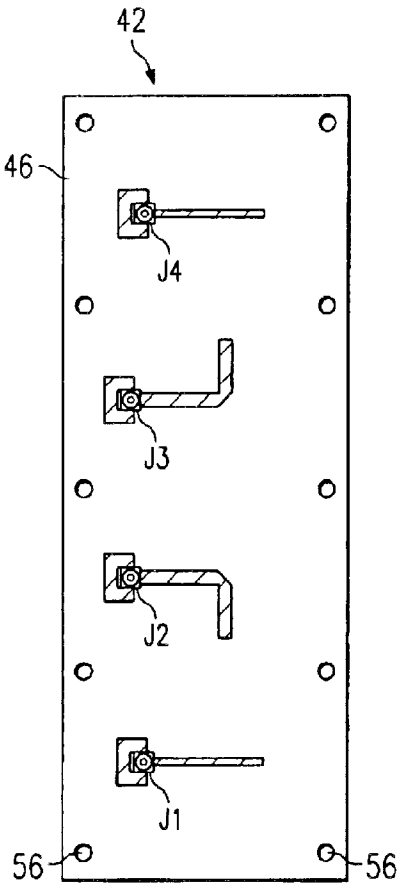
FIG. 8 is a schematic view of the inward-facing surface of the antenna array board of FIG. 7.

Referring now to FIG. 8, an interior side 46 of the antenna array board 42 illustrates the reverse of side 44 of FIG. 7.

The side 46 includes four connectors J1, J2, J3, J4, which may be commonly available surface mount coaxial connectors. The connectors J1–J4 are placed on one side of the antenna array board 42 as illustrated in FIG. 8. The four connectors J1–J4 are operable to connect the antenna array board 42 to another device (not shown), such as a radio frequency (RF) device. For example, the RF device may be an RF power amplifier in a transmitter, while the RF device may be an RF board in a receiver.

Figure 10:
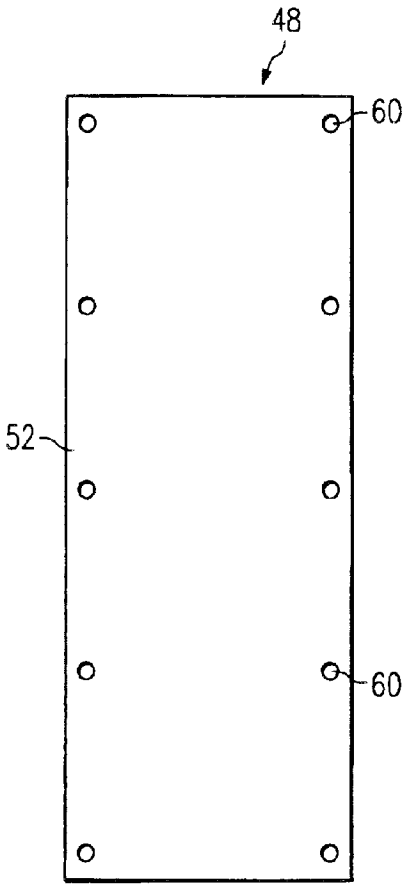
FIG. 10 is a schematic view of the outward-facing surface of the ground plane board of FIG. 9.
Figure 9:
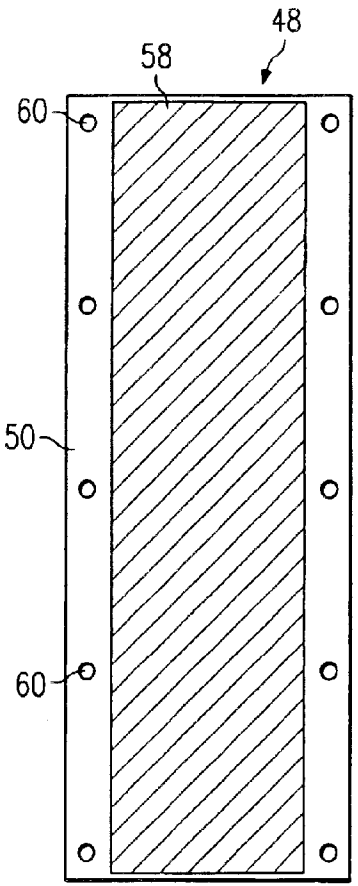
FIG. 9 is a schematic view of the inward-facing surface of a ground plane board.

Referring now to FIGS. 9 and 10, the interior side 50 of the ground plane board 48 includes a reflector 58, which serves to reflect signals as described in greater detail later. The exterior side 52 may be a blank surface as illustrated. As illustrated by both FIGS. 9 and 10, the ground plane board 48 includes ten holes 60 positioned so as to align with the holes 56 of FIGS. 7 and 8. In addition, the ground plane board 48 may include other holes (not shown) operable to enable the ground plane board 48 to be mounted upon or fastened to a surface (not shown).

Figure 11A:
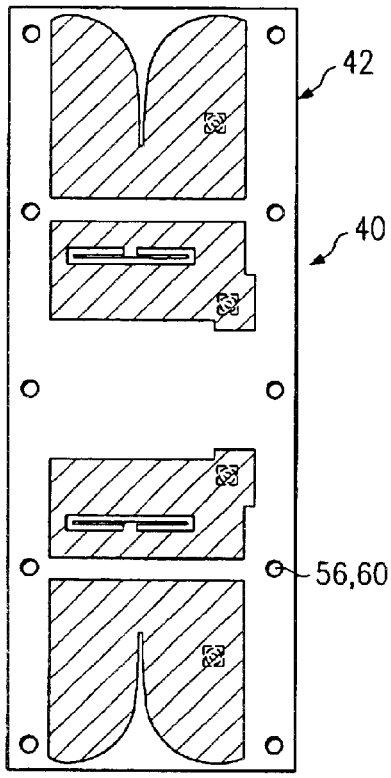
FIGS. 11*a–c* provide an orthographic view of an exemplary antenna system formed by the surfaces illustrated in FIGS. 7–10.
Figure 11C:
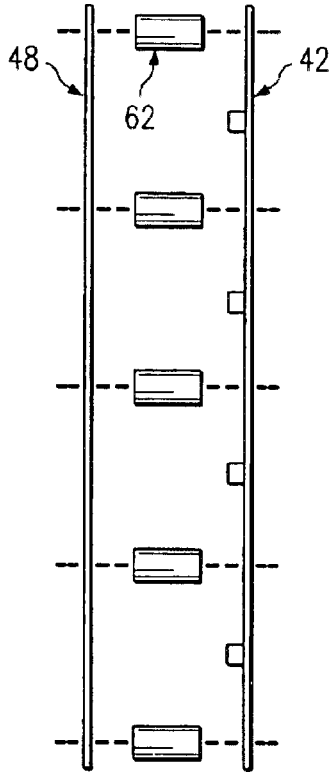
Figure 11B:
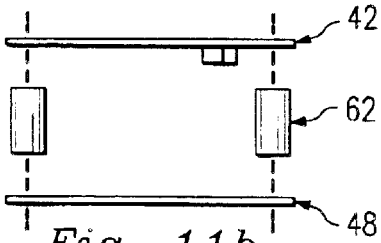

Referring now to FIGS. 11*a*–*c*, the antenna array board 42 of FIGS. 7 and 8, and the ground plane board 48 of FIGS. 9 and 10 may be connected as illustrated to form the antenna system 40. The antenna array board 42 and the ground plane board 48 are positioned so that they are separated by a desired distance using nylon spacers 62. For example, the two boards 42 and 48 may be separated by a distance of 12 millimeters (mm). The spacers 62 may be placed as illustrated, or an alternative number of spacers 62 may be utilized and/or positioned so as to achieve a desirable level of connectability. The spacers 62 are placed so that screws or other fastening means may connect the boards 42 and 48 at the location of the holes 56 and 60, respectively. Alternatively, the use of an adhesive fastener would enable the spacers 62 to be positioned elsewhere on the boards.

The orientation of the boards 42, 48, is such that the respective interior sides 46, 50, face each other and the respective exterior sides 44, 52, face away from each other. In this orientation, the reflector 58 serves to reflect signals towards the elements E1–E4.

Figure 12:
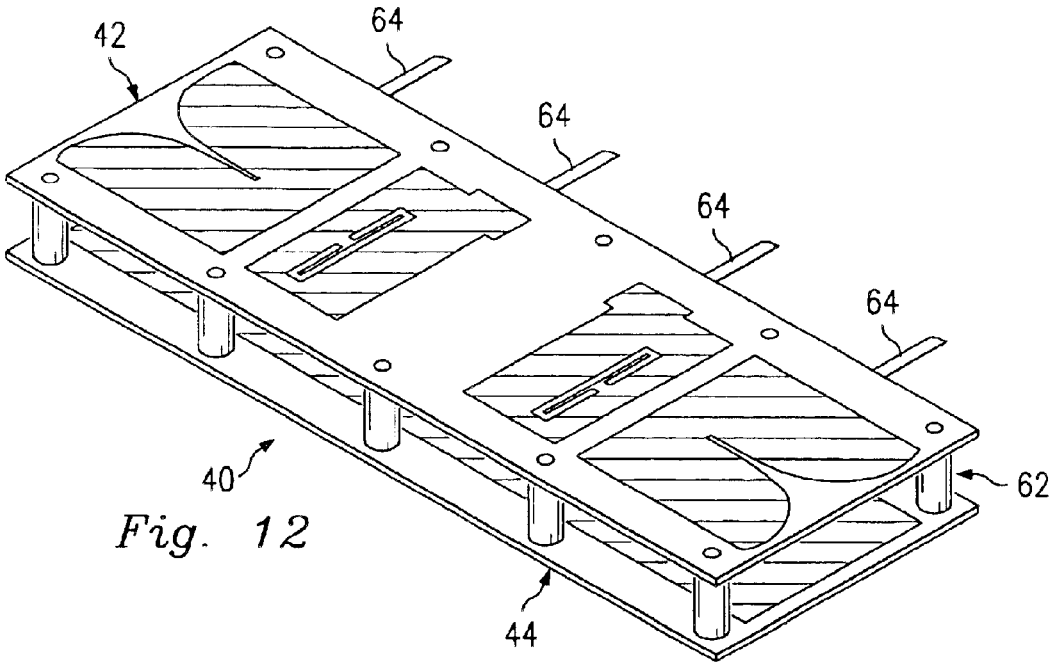
FIG. 12 is an isometric view of the antenna system of FIG. 11.

Referring now to FIG. 12, the orientation of the boards 42, 48, is further illustrated. Also shown are four RF coaxial cables 64 connectable to the connectors J1–J4 of FIG. 8.

The antenna arrays according to the above embodiments may be printed circuit 4-element antenna arrays using a substrate of commercial specifications. Additionally, they may have operating frequencies (VSWR<1.4), at least in the range of 5.725–5.825 gigahertz (GHz), and a radiation front-to-back-ratio of <–12 db.

As previously described, the antenna systems support both space diversity and angle diversity. It is understood that the values set forth above are for the purposes of example only and can be varied within the scope of the invention.

Figure 13:
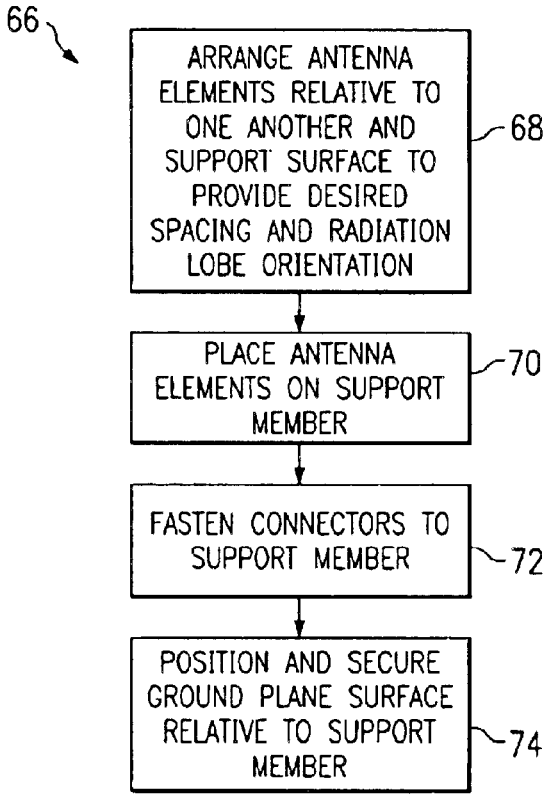
FIG. 13 is a flowchart of an exemplary method for providing an antenna system.

Referring now to FIG. 13, in still another embodiment, an illustrative method 66 may provide an antenna operable to function in clear line of sight and obscured line of sight conditions by implementing space and angle diversity characteristics. For example, the method 66 may begin in step 68 by arranging a plurality of antenna elements and their associated radiation lobes relative to one another and a support surface. Such arranging may include spacing the elements apart by some predefined distance and orienting the radiation lobes at diverse angles as previously described.

In step 70, the elements may be placed on the support surface, which may be the above described antenna array boards 12, 42 of FIGS. 1 and 7. A plurality of connectors corresponding to the plurality of antenna elements may then be fastened to the support surface in step 72 to enable signal communication with the antenna elements. If desired, a ground plane surface may be positioned at a predefined distance from the support surface and secured to the support surface in step 74.

In other embodiments, it may be desirable to arrange the antenna elements so as to provide overlapping radiation patterns. It may also be desirable to organize the antenna elements into first and second portions having an identical number and arrangement of antenna elements. The antenna elements comprising the first and second portions may then be disposed onto first and second halves of the support surface, respectively.

While the invention has been particularly shown and described with reference to the preferred embodiment thereof, it will be understood by those skilled in the art that various changes in form and detail may be made therein without departing from the spirit and scope of the invention.

What is claimed is:

1. A device for improving antenna performance by combining space and angle diversity characteristics, the device comprising:

an antenna array board having substantially identical independent first and second antenna elements, wherein the first and second antenna elements include first and second radiation lobes, respectively, and wherein the first and second antenna elements are positioned so that the first and second radiation lobes are directed towards diverse azimuth angles; and substantially identical independent third and fourth antenna elements different from the first and second antenna elements, wherein the third and fourth antenna elements include third and fourth radiation lobes, respectively, and wherein the third and fourth antenna elements are positioned so that the third and fourth radiation lobes are directed towards diverse azimuth angles, wherein the first, second, third, and fourth antenna elements are disposed on a first side of the antenna board so that a line extending perpendicularly from the first side of the antenna array board will intersect no more than one antenna element; and first, second, third, and fourth connectors positioned proximate to the first, second, third, and fourth antenna elements, respectively, for providing an independent signal path for each antenna element.

2. The device of claim 1 wherein the first and second antenna elements are further positioned so that a first radiation pattern associated with the first antenna element overlaps a second radiation pattern associated with the second antenna element.

3. The device of claim 1 further comprising a ground plane board positioned substantially parallel to the antenna array board, the ground plane board having a reflective surface for directing radio waves towards the antenna array board.

4. The device of claim 3 further comprising a plurality of spacers for separating the antenna array board and the ground plane board.

5. The device of claim 1 wherein the first and second antenna elements are disposed on a first side of the antenna array board and the first and second connectors are disposed on a second side of the antenna array board.

6. The device of claim 1 wherein the antenna array board is divided into first and second portions, and wherein the first and third antenna elements are positioned in the first portion and the second and fourth antenna elements are positioned in the second portion.

7. The device of claim 6 wherein the first and third antenna elements and the second and fourth antenna elements are positioned in a similar manner in the first and second portions, respectively.

8. A method for providing an antenna operable to function in clear line of sight and obscured line of sight conditions by providing space and angle diversity characteristics, the method comprising:

arranging a plurality of antenna elements relative to one another and a first side of a support surface, wherein each antenna element is independent and includes a radiation lobe, the arranging including:

organizing the antenna elements into first and second portions having an identical number and arrangement of antenna elements;

spacing the antenna elements apart so that any line extending perpendicularly from the first side of the support surface will intersect at most one antenna element; and orienting the radiation lobes at diverse angles;

placing the arranged antenna elements on the support surface; and fastening a plurality of connectors corresponding to the plurality of antenna elements to the support surface, wherein the connectors are in signal communication with the antenna elements.

9. The method of claim 8 wherein the arranging the plurality of antenna elements further includes providing overlapping radiation patterns.

10. The method of claim 8 further comprising:

positioning the support surface at a predefined distance from a ground plane surface; and securing the support surface to the ground plane surface.

11. An antenna for overcoming deleterious effects of multipath, the antenna comprising a single support member; and a plurality of antenna elements disposed on a first side of the support member, wherein the first side of the support member comprises first and second halves, wherein each half has an identical number of antenna elements disposed in an identical manner thereon, wherein each of the antenna elements includes a main radiation lobe, and wherein the antenna elements are arranged so that each antenna element is spaced from the other antenna elements and the main radiation lobes are oriented towards different angles, and wherein the antenna elements include a first pair of antenna elements having a first shape and a second pair of antenna elements having a second shape different than the first shape, wherein one antenna element of each of the first and second pairs is disposed in each half.

12. An antenna having space and angle diversity comprising:

a single support member having a first side divided into first and second portions; and a plurality of independent antenna elements each having a main radiation lobe and arranged so that each antenna element is spaced from the other antenna elements, wherein the antenna elements include a first pair of antenna elements having a first shape and a second pair of antenna elements having a second shape different than the first shape, wherein one antenna element of each of the first and second pairs is located in each of the first and second portions.

13. The antenna of claim 12 further comprising at least one connector in signal communication with each antenna element, wherein each of the antenna elements is connected independently from each of the other antenna elements.

14. The antenna of claim 12 wherein the antenna elements are positioned in each portion in an identical manner.

15. The antenna of claim 12 wherein the first pair of antenna elements are each shaped to form a vivaldi antenna and the second pair of antenna elements are each shaped to form a slot antenna.

16. The antenna of claim 12 wherein the main radiation lobes overlap for a number of azimuth angles.

17. The antenna of claim 16 wherein a combined lobe formed from the main radiation lobes has a beamwidth greater than 150 degrees.

18. The antenna of claim 17 wherein each antenna element has a 3 dB beamwidth of approximately 60 degrees.

19. The antenna of claim 12 further comprising a reflective member positioned proximate to the support member, the reflective member having a reflective surface for reflecting signals towards the antenna elements.

20. A device for improving antenna performance by combining space and angle diversity characteristics, the device comprising:

an antenna array board having substantially identical independent first and second antenna elements and substantially identical independent third and fourth antenna elements different from the first and second antenna elements, wherein the first and third antenna elements are positioned on a first portion of the antenna array board and the second and fourth antenna elements are positioned on a second portion of the antenna array board; and first, second, third, and fourth connectors positioned proximate to the first, second, third, and fourth antenna elements, respectively, for providing an independent signal path for each antenna element.

* * * * *